US009075389B2

(12) United States Patent
Miwa

(10) Patent No.: US 9,075,389 B2
(45) Date of Patent: Jul. 7, 2015

(54) IMAGE FORMING APPARATUS WITH PRESSING PORTION AND GUIDE

(71) Applicant: Atsushi Miwa, Anjo (JP)

(72) Inventor: Atsushi Miwa, Anjo (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/834,104

(22) Filed: Mar. 15, 2013

(65) Prior Publication Data

US 2013/0259518 A1 Oct. 3, 2013

(30) Foreign Application Priority Data

Mar. 30, 2012 (JP) ..... 2012-081545

(51) Int. Cl.
*G03G 21/18* (2006.01)
*G03G 21/16* (2006.01)

(52) U.S. Cl.
CPC ..... *G03G 21/1842* (2013.01); *G03G 21/1633* (2013.01); *G03G 21/1853* (2013.01)

(58) Field of Classification Search
CPC ..... G03G 21/1628; G03G 21/1633; G03G 21/18; G03G 21/1839; G03G 21/1842; G03G 21/1846; G03G 2221/18; G03G 2221/183; G03G 2221/1846; G03G 2221/1884
USPC ..... 399/110, 111, 125
See application file for complete search history.

(56) References Cited

U.S. PATENT DOCUMENTS 5,581,338 A 12/1996 Nakamichi et al.
5,634,178 A 5/1997 Sugiura et al.
5,907,751 A 5/1999 Kawaguchi et al.
5,983,054 A * 11/1999 Kameyama ..... 399/125
6,101,350 A 8/2000 Suzuki et al.
6,229,974 B1 * 5/2001 Noda ..... 399/111
7,174,117 B2 2/2007 Okabe
7,764,903 B2 7/2010 Ishikawa et al.
8,606,141 B2 12/2013 Furuya et al.

(Continued)

FOREIGN PATENT DOCUMENTS

JP 2000-250310 A 9/2000
JP 2007-163879 A * 6/2007

(Continued)

OTHER PUBLICATIONS

Co-pending U.S. Appl. No. 13/834,598, filed Mar. 15, 2013.

(Continued)

*Primary Examiner* — Sophia S Chen
(74) *Attorney, Agent, or Firm* — Banner & Witcoff, Ltd.

(57) ABSTRACT

An image forming apparatus includes a casing having an opening that is open upward, a cover supported by the casing, a process cartridge configured to be attached to or removed from the casing through the opening, and a particular guide configured to guide the process cartridge when the process cartridge is attached to or removed from the casing. The cover is configured to pivot around a pivot axis to open and close the opening. The cover includes a pressing portion. The pressing portion is configured to, when the cover is closing the opening, contact the process cartridge being attached inside the casing and press the process cartridge toward an attachment position in which the process cartridge is attached to the casing. A path of the pressing portion in the casing is substantially same as a shape of the particular guide as viewed from an axial direction of the pivot axis.

11 Claims, 10 Drawing Sheets

(56) References Cited

U.S. PATENT DOCUMENTS

| | | | | |
|---|---|---|---|---|
| 2006/0158686 | A1 | 7/2006 | Watanabe | |
| 2008/0145095 | A1 | 6/2008 | Hoshi et al. | |
| 2008/0152386 | A1 * | 6/2008 | Sakaguchi et al. | 399/114 |
| 2011/0158682 | A1 | 6/2011 | Takagi et al. | |
| 2011/0170905 | A1 | 7/2011 | Furuya et al. | |
| 2011/0243601 | A1 | 10/2011 | Furuya et al. | |
| 2011/0311269 | A1 | 12/2011 | Murooka | |

FOREIGN PATENT DOCUMENTS

| | | | | |
|---|---|---|---|---|
| JP | 2007-163880 | A | * | 6/2007 |
| JP | 2008-224782 | A | | 9/2008 |
| JP | 4474178 | B2 | | 6/2010 |
| JP | 2011-008286 | A | | 1/2011 |
| JP | 4667444 | B2 | | 4/2011 |
| JP | 4701313 | B2 | | 6/2011 |
| JP | 4721464 | B2 | | 7/2011 |
| JP | 2011-164587 | A | | 8/2011 |
| JP | 2011-227457 | A | | 11/2011 |

OTHER PUBLICATIONS

Co-pending U.S. Appl. No. 13/834,874, filed Mar. 15, 2013.
Non-Final Office Action received in corresponding U.S. Appl No. 13/834,598 mailed Jul. 7, 2014.
Aug. 13, 2014 (US) Notice of Allowance—U.S. Appl. No. 13/834,874.
Dec. 16, 2014—(US) Final Office Action—U.S. Appl. No. 13/834,598.
Feb. 2, 2015—(CN) Notification of First Office Action—App 201310091197.X.
Mar. 3, 2015—(CN) First Office Action—App 201310091199.9.
Mar. 20, 2015—(CN) Notification of the First Office Action—App 201310091198.4.

* cited by examiner

IMAGE FORMING APPARATUS WITH PRESSING PORTION AND GUIDE

CROSS REFERENCE TO RELATED APPLICATION

This application claims priority from Japanese Patent Application No. 2012-081545, filed on Mar. 30, 2012, which is incorporated herein by reference in its entirety.

FIELD

Aspects of the disclosure relate to an image forming apparatus including a casing and a process cartridge detachably attachable to the casing.

BACKGROUND

A known image forming apparatus includes a process cartridge detachably attachable to a main body of the image forming apparatus by being guided by a guide provided in the main body. Specifically, the main body includes a casing having an opening that is open upward and a cover to open and close the opening. The guide is formed in the casing and extends diagonally from the opening to a rear side of the casing.

In the image forming apparatus, the cover includes a pressing portion configured to press the process cartridge being attached toward an attachment position when the cover closes the opening. The pressing portion is configured to contact a horizontal surface of the process cartridge and press the horizontal surface vertically.

SUMMARY

However, in the above-described art, a direction in which the guide extends is different from a direction in which the pressing portion presses the process cartridge, and thus the user needs to press the cover strongly when closing it.

Illustrative aspects of the disclosure provide an image forming apparatus configured such that a cover is closed lightly while a process cartridge is moved to its attachment position.

According to an aspect of the disclosure, an image forming apparatus includes a casing having an opening that is open upward, a cover supported by the casing, a process cartridge configured to be attached to or removed from the casing through the opening, and a particular guide configured to guide the process cartridge when the process cartridge is attached to or removed from the casing. The cover is configured to pivot around a pivot axis to open and close the opening. The cover includes a pressing portion. The pressing portion is configured to, when the cover is closing the opening, contact the process cartridge being attached inside the casing and press the process cartridge toward an attachment position in which the process cartridge is attached to the casing. A path of the pressing portion in the casing, while the cover pivots, is substantially same as a shape of the particular guide as viewed from an axial direction of the pivot axis.

BRIEF DESCRIPTION OF THE DRAWINGS

Illustrative aspects will be described in detail with reference to the following figures in which like elements are labeled with like numbers and in which.

DETAILED DESCRIPTION

A first illustrative embodiment will be described in detail with reference to the accompanying drawings. In the following description, a general structure of a laser printer, as an example of an image forming apparatus, will be described and then features of the disclosure will be described in detail.

In the following description, orientations or sides of the laser printer will be identified based on the laser printer disposed in an orientation in which it is intended to be used. In other words, in FIG. 1, the left side is referred to as the front or front side, the right side is referred to as the rear or the rear side, the up side is referred to as the top or upper side, and the down side is referred to as the bottom or lower side. The top and bottom direction may be referred to as a vertical direction.

Figure 1:
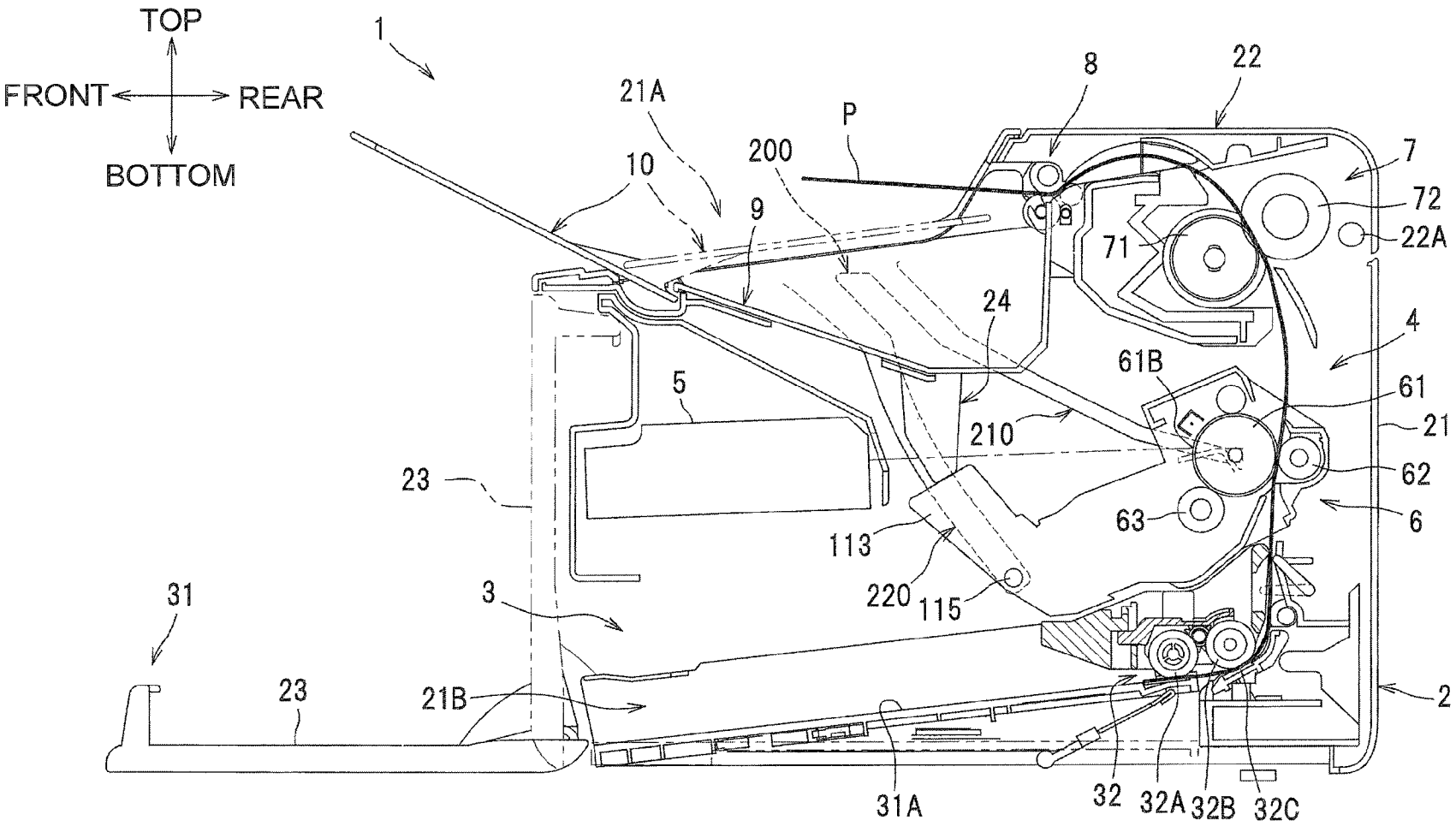
FIG. 1 illustrates a general structure of an illustrative image forming apparatus, e.g. a laser printer, according to an embodiment of the disclosure.

As shown in FIG. 1, the laser printer 1 includes a main body 2, a feeder portion 3 for feeding a sheet P, and an image forming portion 4 for forming an image on the sheet P.

The main body 2 includes a casing 21, a top cover 22 as an example of a cover, and a front cover 23. The casing 21 has an opening 21A (FIG. 2), which is open upward, for attaching and removing a process cartridge 6 in an upper portion, and an insertion opening 21B for inserting sheets P in a front portion.

Specifically, the dimension of the opening 21A in the left-right direction is substantially equal to that of the process cartridge 6, and the dimension of the opening 21A in the front-rear direction is smaller than the dimension of the process cartridge 6 in a direction where a photosensitive drum 61 and a handle portion 113 are arranged.

The top cover 22 is sized to cover the entire of the upper side of the casing 21 and is supported by the casing 21 such that the top cover 22 is configured to pivot about a pivot 22A disposed in a rear end portion of the casing 21. Thus, by being moved vertically, the top cover 22 is configured to open and close the opening 21A.

An upper surface of the top cover 22 contains an ejection tray 9 on which a sheet P ejected by an ejection roller 8 outside the casing 21 is to be placed. The ejection tray 9 includes an extension cover 10. The extension cover 10 is supported by the top cover 22 such that the extension cover 10 is configured to pivot about a pivot shaft (not shown) disposed in a front end portion of the top cover 22. The extension cover 10 is configured to move between a position (indicated by a double dotted line) covering an upper surface of the ejection tray 9 and a position (indicated by a solid line) approximate to the ejection tray 9 supporting the leading end portion of a sheet P on the ejection tray 9.

The front cover 23 is a cover covering a front surface of the casing 21 and is pivotally supported at its lower end portion by the casing 21. With this structure, by being pivoted in the front-rear direction, the front cover 23 is configured to open and close the insertion opening 21B of the casing 21.

The feeder portion 3 is disposed in a lower portion of the main body 2, and includes a sheet tray 31 for placing a sheet P thereon and a sheet feed mechanism 32 that feeds a sheet P on the sheet tray 31 toward the image forming portion 4.

The sheet tray 31 includes the front cover 23 and a sheet receiving plate 31A, which is disposed in a lower portion of the main body 2. Specifically, when tilted frontward, the front cover 23 constitutes a part of the sheet tray 31. The sheet receiving plate 31A is configured to raise a sheet P toward a feed roller 32A at timing when one sheet P is fed.

The sheet feed mechanism 32 includes the feed roller 32A, a separation roller 32B, and a separation pad 32C. The feed roller 32A is disposed upstream of the separation roller 32B in a sheet conveying direction, and above the rear end of the sheet receiving plate 31A. The separation roller 32B is disposed facing the separation pad 32C.

In the feeder portion 3, the front cover 23 is tilted down frontward to form the sheet tray 31, and a sheet P is placed on the sheet tray 31. The feed roller 32A rotates in contact with the sheet P placed on the sheet tray 31, and the sheet P placed on the sheet tray 31 is conveyed to the separation roller 32B, the fed sheet P is singly separated by the separation roller 32B and the separation pad 32C and conveyed to the image forming portion 4.

The image forming portion 4 includes a scanner unit 5, a process cartridge 6, and a fixing unit 7.

The scanner unit 5 is disposed above a front side of the feeder portion 3 in the main body 2, and includes a laser emitting portion, a polygon mirror, and a lens, which are not shown. The scanner unit 5 irradiates a surface of a photosensitive drum 61, as an example of a photosensitive member, with a laser beam at high speed scanning.

The process cartridge 6 is disposed above a rear side of the feeder portion 3 in the main body 2, and is detachable through the opening 21A from the casing 21. The process cartridge 6 includes a photosensitive drum 61, a transfer roller 62 facing the photosensitive drum 61, an unnumbered charger, a developing roller 63, and a toner chamber, which is not shown.

In the process cartridge 6, the surface of the photosensitive drum 61, which is rotating, is uniformly charged by the charger, and then exposed with the laser beam from the scanner unit 5 by high speed scanning. Thus, a potential in an exposed area drops, and an electrostatic latent image based on image data is formed on the surface of the photosensitive drum 61.

The developing roller 63 supplies toner in the toner chamber to the electrostatic latent image formed on the photosensitive drum 61, and a toner image is formed on the surface of the photosensitive drum 61. Then, when a sheet P is fed in between the photosensitive drum 61 and the transfer roller 62, the toner image carried on the surface of the photosensitive drum 61 is transferred onto the sheet P.

The fixing unit 7 is disposed above the process cartridge 6 in a rear side of the main body 2. The fixing unit 7 includes a heat roller 71 and a pressure roller 72.

The heat roller 71 is a member that applies heat to a sheet P, and includes inside a heat source, e.g., a halogen lamp.

The pressure roller 72 is a member that feeds a sheet P by sandwiching the sheet P with the heat roller 71, and is disposed diagonally upward from the rear side of the heat roller 71.

The fixing unit 7 structured as described above is configured to fix toner transferred onto the sheet P thermally while the sheet P passes between the heat roller 71 and the pressure roller 72. The sheet P having the toner thermally fixed thereon is conveyed to the ejection roller 8, which is disposed downstream of the fixing unit 7, and ejected from the ejection roller 8 to the ejection tray 9.

The following will describe the structure around the process cartridge 6, which is a feature of the disclosure.

Figure 3:
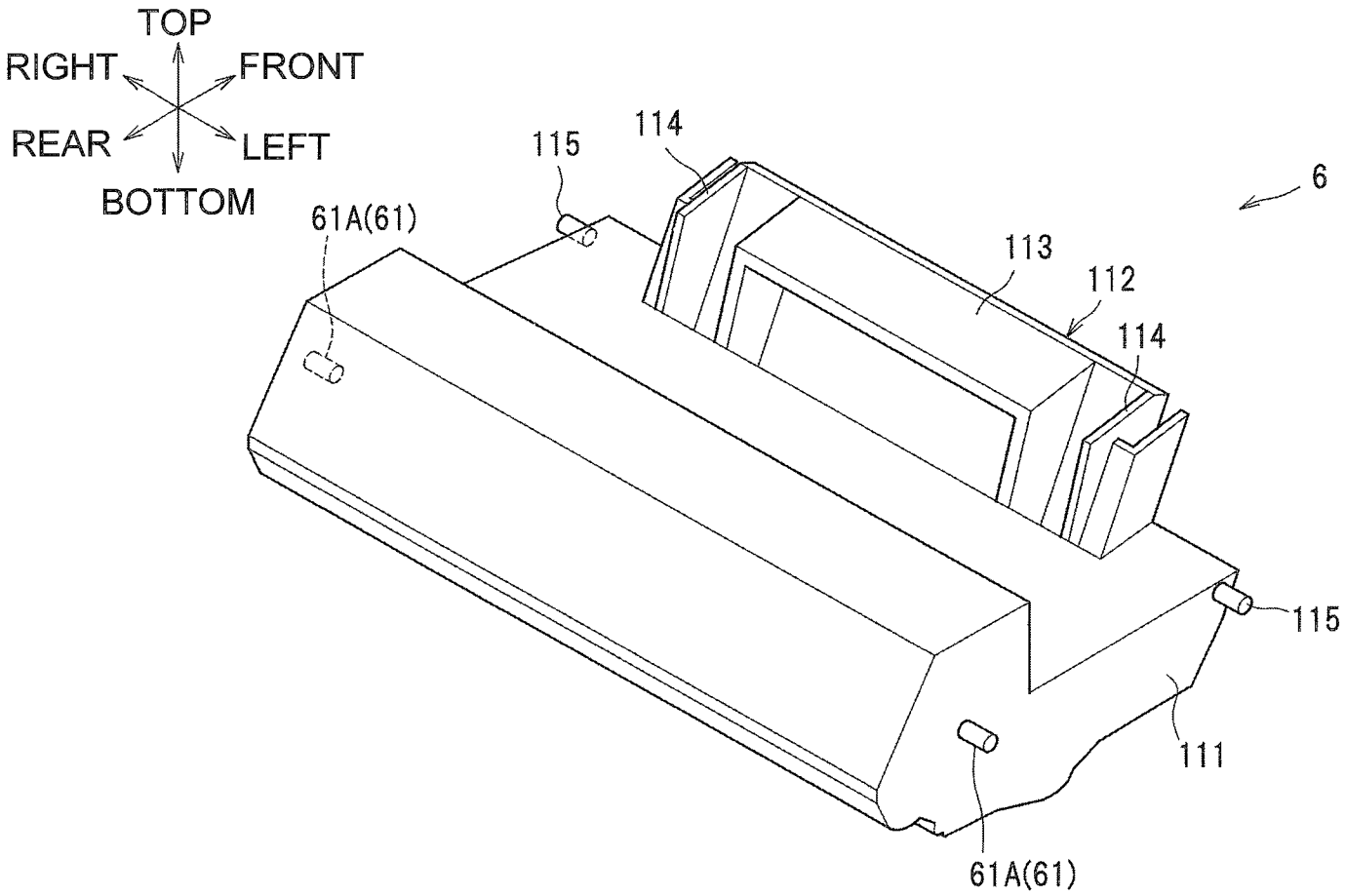
FIG. 3 is a perspective view illustrating the process cartridge.

As shown in FIG. 3, the process cartridge 6 rotatably supports, at its rear end portion, the photosensitive drum 61 and the transfer roller 62 (FIG. 1). A shaft 61A, as an example of a further guided portion, of the photosensitive drum 61, which is supported by the process cartridge 6, extends outside left and right side surfaces 111 of the process cartridge 6.

A front wall 112 disposed in a front end portion of the process cartridge 6 is provided with the handle portion 113 and pressed portions 114. Bosses 115, as an example of a particular guided portion, are disposed on the left and right side surfaces 111 of the process cartridge 6.

The handle portion 113 is a portion held by a user during attachment or removal of the process cartridge 6, and is disposed in substantially a central portion of the process cartridge 6 in the left-right direction.

The pressed portions 114 are portions which respective pressing portions 24 contact when the top cover 22 is closing the opening 21A. The pressed portions 114 are upper end surfaces of ribs protruding rearward from the front wall 112 with the handle portion 113 interposed therebetween.

The bosses 115 are protrusions protruding outward from the left and right side surfaces 111 in the left-right direction. The bosses 115 are disposed in front end portions of the left and right side surfaces 111. The handle portion 113 is disposed closer to the bosses 115 than the shaft 61A of the photosensitive drum 61. The bosses 115 are disposed in upper end portions of front sides of the respective left and right side surfaces 111 and in positions where the bosses 115 overlap the pressed portions 114 in a direction where the shaft 61A and the bosses 115 are arranged and near the pressed portions 114.

As shown in FIG. 1, when attached to the casing 21, the process cartridge 6 structured as described above is disposed with its front end portion being lower than its rear end portion such that the handle portion 113 is disposed in a position lower than an exposure portion 61B of the photosensitive drum 61, which is to be exposed by the scanner unit 5. The scanner unit 5 is disposed in a position upper than the handle portion 113 such that laser light is not cut off by the handle portion 113. By disposing the process cartridge 6 as described above, the scanner unit 5 is disposed in a lower position compared with a case where the handle portion 113 is disposed above the exposure portion 61B of the photosensitive drum 61, and thus the need to increase the physical size of the main body 2 can be obviated.

Figure 2:
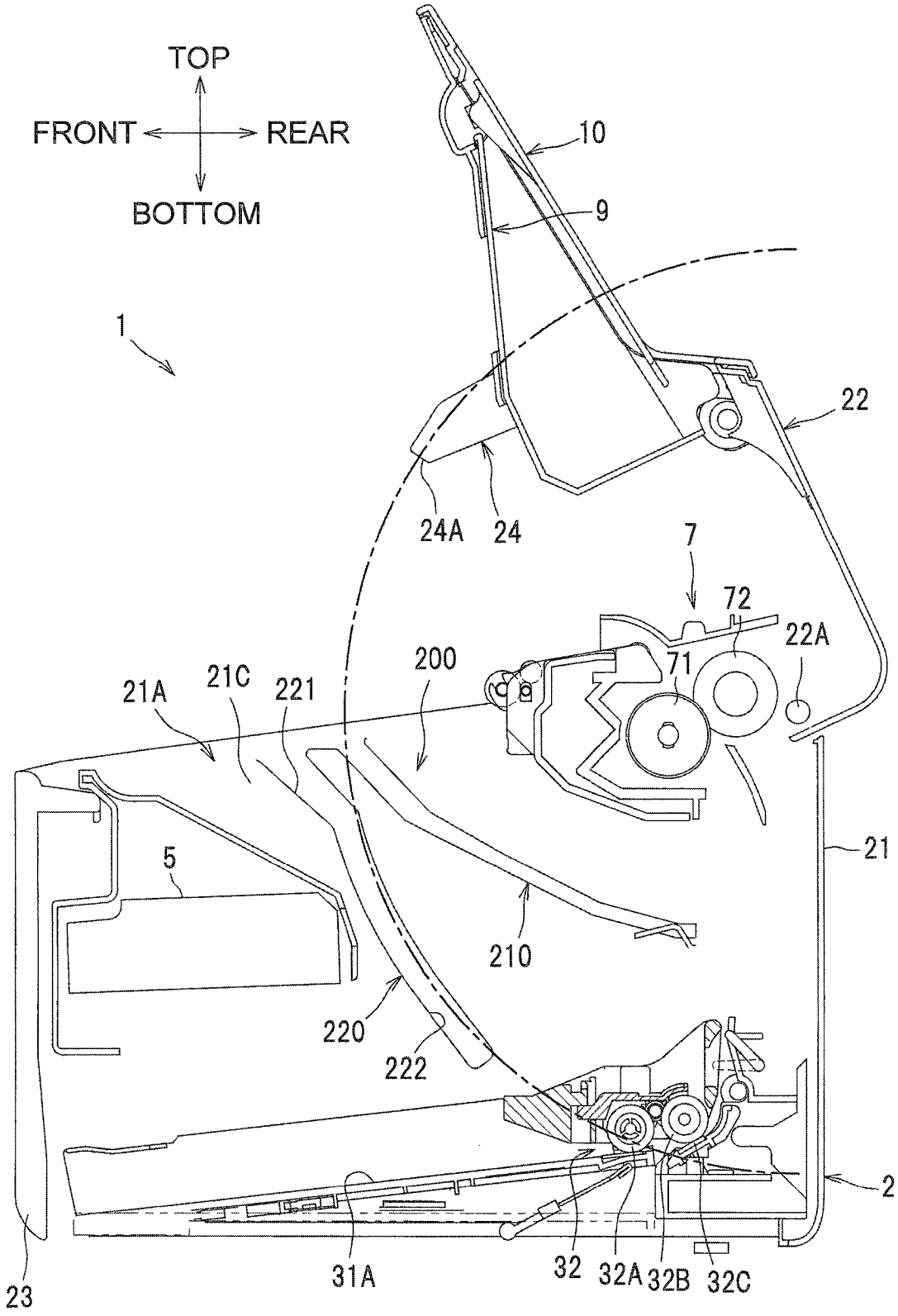
FIG. 2 illustrates the laser printer with a top cover thereof being open, wherein a process cartridge is removed.

As shown in FIG. 2, the main body 2 includes a guide 200 disposed in the casing 21 and the pressing portions 24 disposed in the top cover 22 as a structure to attach and remove the process cartridge 6 with respect to the casing 21.

The guide 200 is made up of a first guide 210 as an example of a further guide and a second guide 220 as an example of a particular guide, and is configured to guide the process cartridge 6 being attached or removed by guiding the shaft 61A of the photosensitive drum 61 by the first guide 210 and guiding the boss 115 by the second guide 220.

In a state that the process cartridge 6 is attached to the casing 21, the lower end of the first guide 210 supports the shaft 61A of the photosensitive drum 61, and the lower end of the second guide 220 supports the corresponding boss 115. Thus, the guide 200 is configured to hold the shaft 61A of the photosensitive drum 61 of the process cartridge 6 attached to the casing 21 and the boss 115 at their attachment positions (FIG. 1).

Specifically, the first guide 210 is a groove formed in an inner surface of a side panel 21C disposed on each of the left and right sides of the casing 21. The first guide 210 is shaped to extend in an attaching direction where the process cartridge 6 is attached or diagonally downward from the opening 21A to the inside of the casing 21 such as to connect an upper end of the side panel 21C and the attachment position of the shaft 61A of the photosensitive drum 61.

The second guide 220 is a groove formed in the inner surface of the side panel 21C of the casing 21 in front of the first guide 210. The second guide 220 is shaped to connect the attachment position of the boss 115 and the upper end of the side panel 21C. The second guide 220 has an upper portion 221 disposed on an upstream side in the attaching direction of the process cartridge 6 and a lower portion 222 disposed on a downstream side in the attaching direction of the process cartridge 6.

The upper portion 221 extends from the upper end of the side panel 21C substantially straightly along the first guide 210. The lower portion 222 extends smoothly from a lower end of the upper portion 221 to the stop position of the boss 115, and is curved away from the first guide 210. A first surface, defining the lower portion 222, facing the first guide 210 is concave in a direction away from the first guide 210, and a second surface, of the lower portion 222, facing away from the first guide 210 is convex in the direction away from the first guide 210. The lower portion 222 extends in a direction crossing a direction where the upper portion 221 extends. In other words, the second guide 220 is bent at a portion where the upper portion 221 merges with the lower portion 222.

The second guide 220 is longer in the vertical length than the first guide 210, and the lower end of the second guide 220 is located lower than the lower end of the first guide 210. The bent portion of the second guide 220 is disposed in a position closer to the upper end of the side panel 21C than the attachment position of the boss 115. The first guide 210 and the second guide 220 have such lengths that, during attaching of the process cartridge 6, the boss 115 is guided to its attachment position after the shaft 61A of the photosensitive drum 61 is guided to its attachment position.

The pressing portions 24 are members that, when the top cover 22 closes the opening 21A, contact the pressed portions 114 of the process cartridge 6 being attached and press the process cartridge 6 into an attachment position in which the process cartridge 6 is attached to the casing 21.

Figure 4:
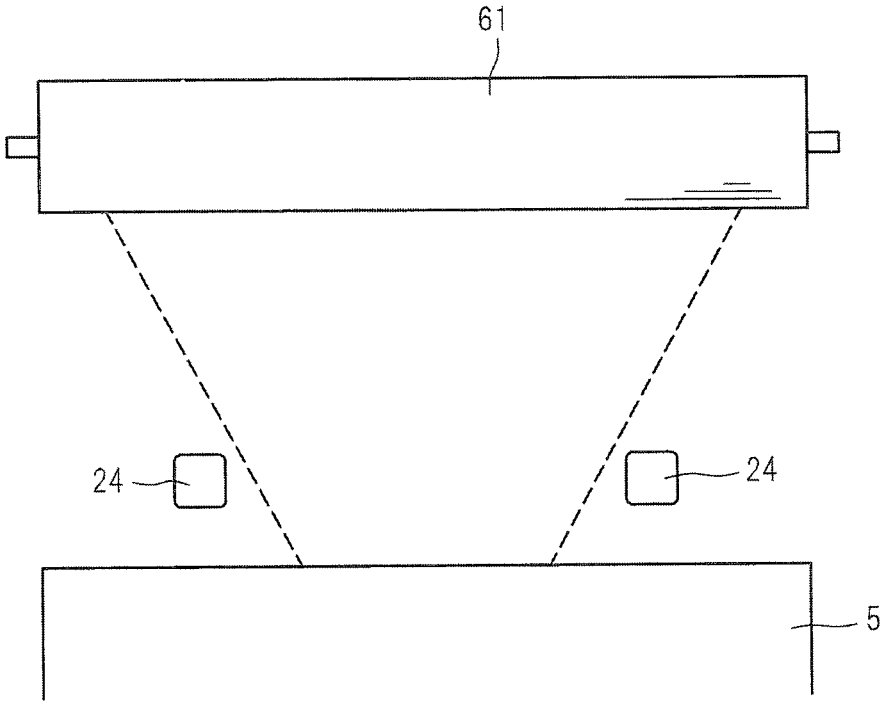
FIG. 4 illustrates a range in which a laser beam to be emitted from a scanner unit passes and positions of pressing portions.

Specifically, the pressing portions 24 are disposed on a surface of the top cover 22 opposite to the ejection tray 9 and protrude inside of the casing 21 from the top cover 22 when the top cover 22 closes the opening 21A. As shown in FIG. 4, the pressing portions 24 are disposed one by one on the left and right sides to correspond the pressed portions 114 of the process cartridge 6. The pressing portions 24 are arranged such that laser light emitted from the scanner unit 5 passes between the pressing portions 24. In other words, the pressing portions 24 are disposed outside of a range where the laser light passes (or a range inside broken lines in FIG. 4).

Figure 10:
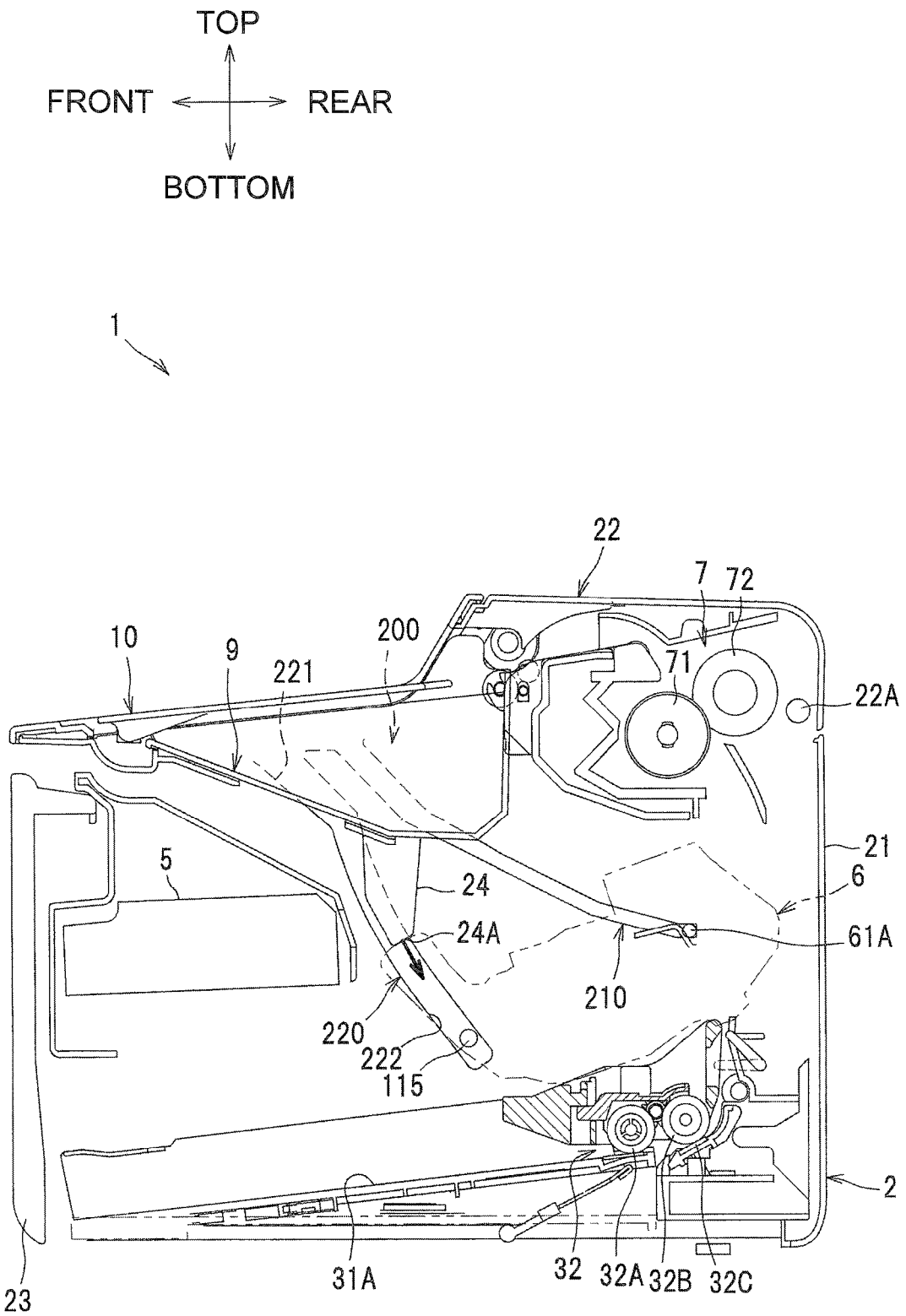
FIG. 10 illustrates that the pressing portion contacts the process cartridge being attached.

As shown in FIG. 2, an end surface of the pressing portion 24 is a pressing surface 24A, as an example of a pressing portion, to contact the pressed portion 114 of the process cartridge 6. A path of the pressing surface 24A in the casing 21 while the top cover 22 is opened or closed (indicated by an alternate long and short dashed line) is substantially same as the shape of the second guide 220. Specifically, in the course of closing the top cover 22, the path of the pressing surface 24A for a period of time from when the pressing surface 24A contacts the pressed portion 114 to when the process cartridge 6 moves to the attachment position is substantially same as the shape of the second guide 220 through which the boss 115 passes. The pressing surface 24A is shaped such as to, when contacting the pressed portion 114, face toward the attaching direction of the boss 115 such that a direction in which the pressing surface 24A presses the pressed portion 114 is substantially parallel to a direction in which the second guide 220 extends in proximity to the boss 115 (FIG. 10).

As the attaching direction of the process cartridge 6 agrees with the direction where the pressing surface 24A presses the pressed portion 114, the user can close the top cover 22 while moving the process cartridge 6 to the attachment position lightly.

With this structure, the boss 115 is not pressed to the second guide 220 with a force that the pressing portion 24 presses the pressed portion 114. When the user closes the top cover 22, the process cartridge 6 is moved to the attachment position with a small force.

The pressing portion 24 is disposed in such a position in the front-rear direction as to, when the pressing portion 24 contacts the pressed portion 114 of the process cartridge 6, overlap the second guide 220 in a radial direction of a circle centered on the pivot 22A (a pivot axis) of the top cover 22. In other words, the pressing portion 24 is disposed so as to overlap the second guide 220 as viewed from an axial direction of the pivot 22A.

This positional relationship reduces the potential of the process cartridge 6 from being twisted when being pressed by the pressing portion 24, compared with a case where the pressing portion 24 is disposed in a position away from the second guide 220 in the radial direction of the circle centered on the pivot 22A of the top cover 22.

The following will describe how the process cartridge 6 is attached to or removed from the casing 21.

Figure 5:
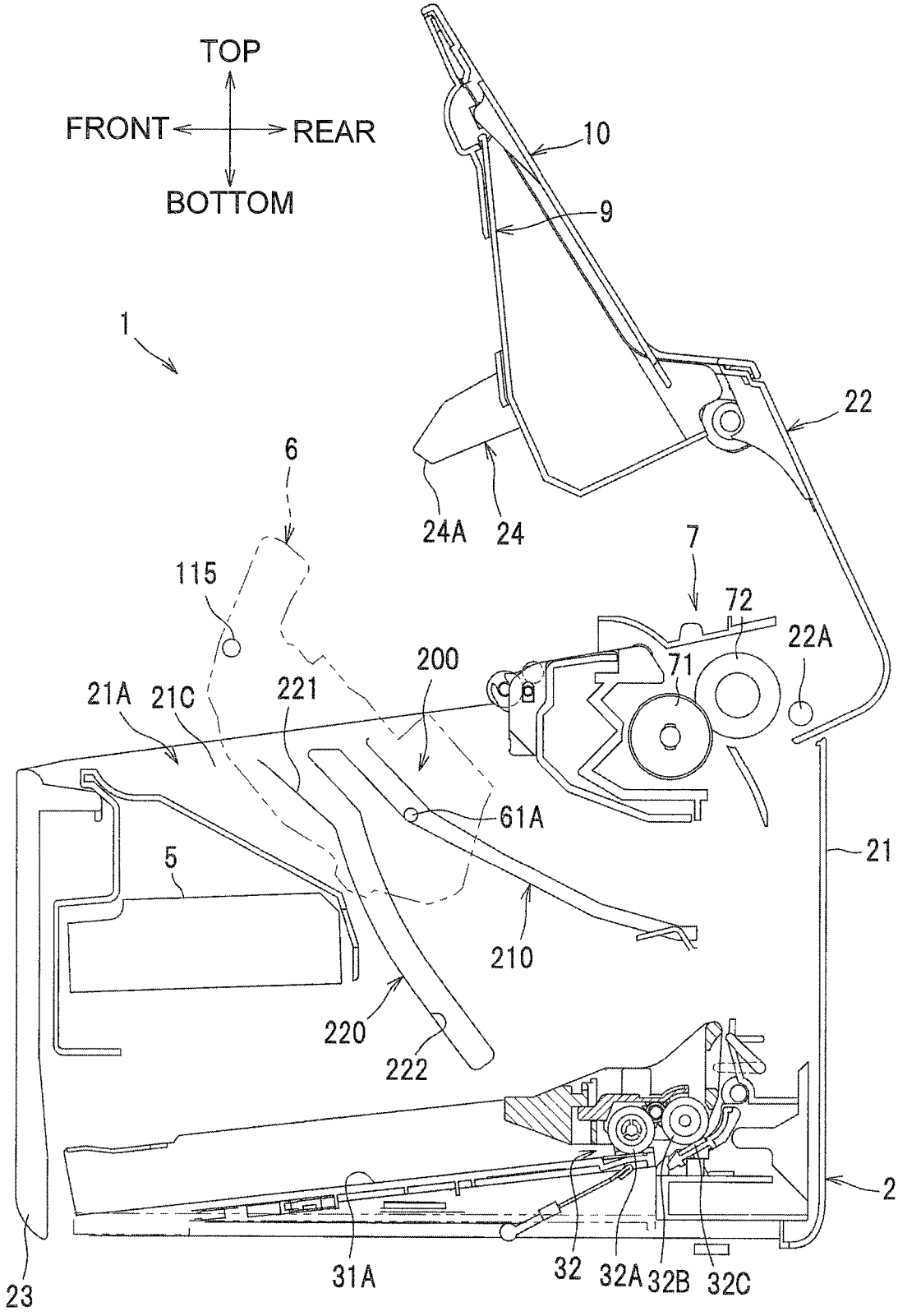
FIG. 5 illustrates that, when the process cartridge is attached, a shaft of a photosensitive drum is guided by a first guide.

In case of attaching the process cartridge 6 to the casing 21, a user opens the top cover 22, holds the handle portion 113, and brings the process cartridge 6 close to the casing 21 from the photosensitive drum 61 side. As shown in FIG. 5, the user inserts the shaft 61A of the photosensitive drum 61 into the first guide 210 to move the process cartridge 6 into the casing 21 along the first guide 210.

Figure 6:
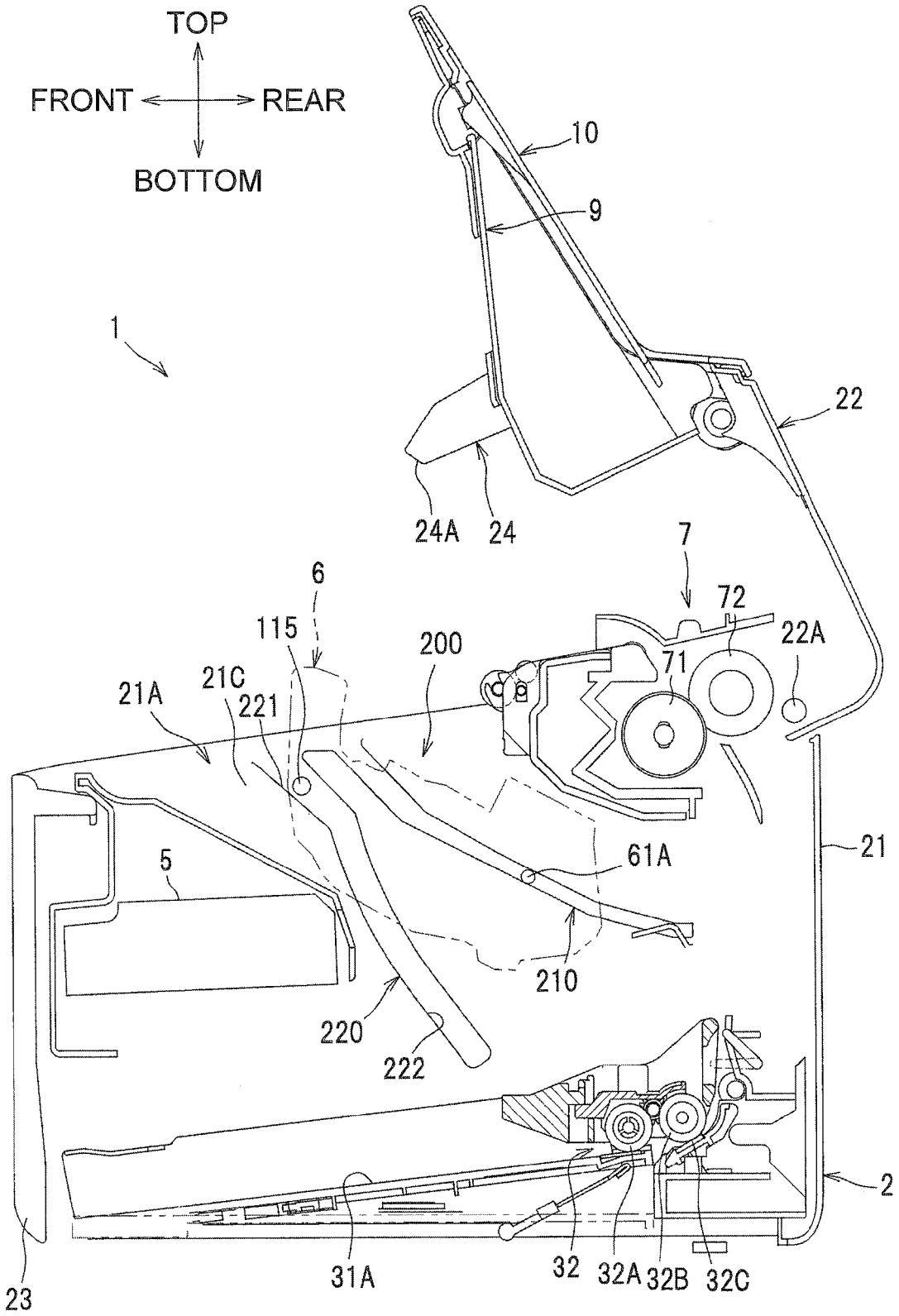
FIG. 6 illustrates that, when the process cartridge is attached, a boss is guided by an upper portion of a second guide.
Figure 7:
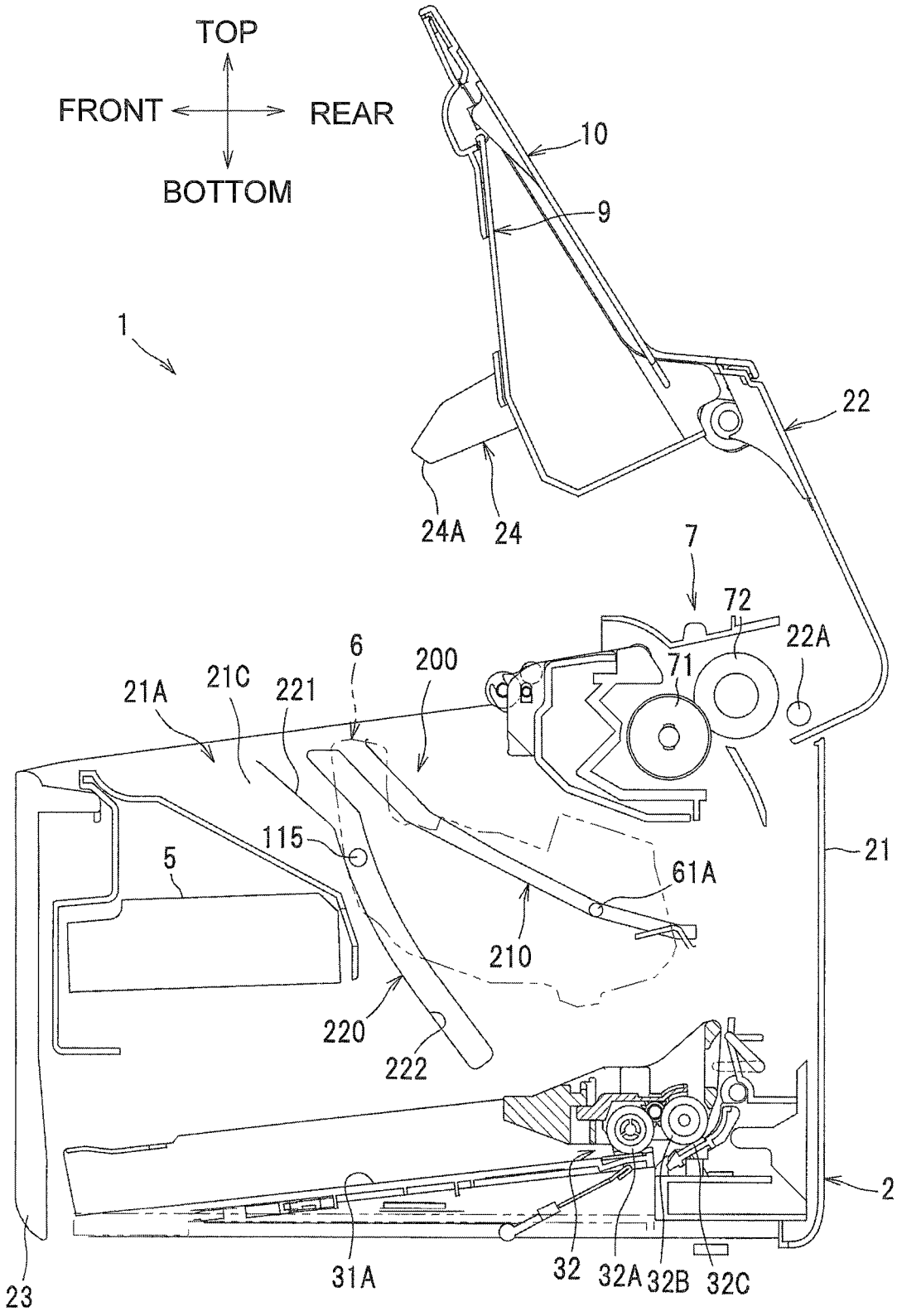
FIG. 7 illustrates that, when the process cartridge is attached, the boss is guided by a lower portion of the second guide.
Figure 8:
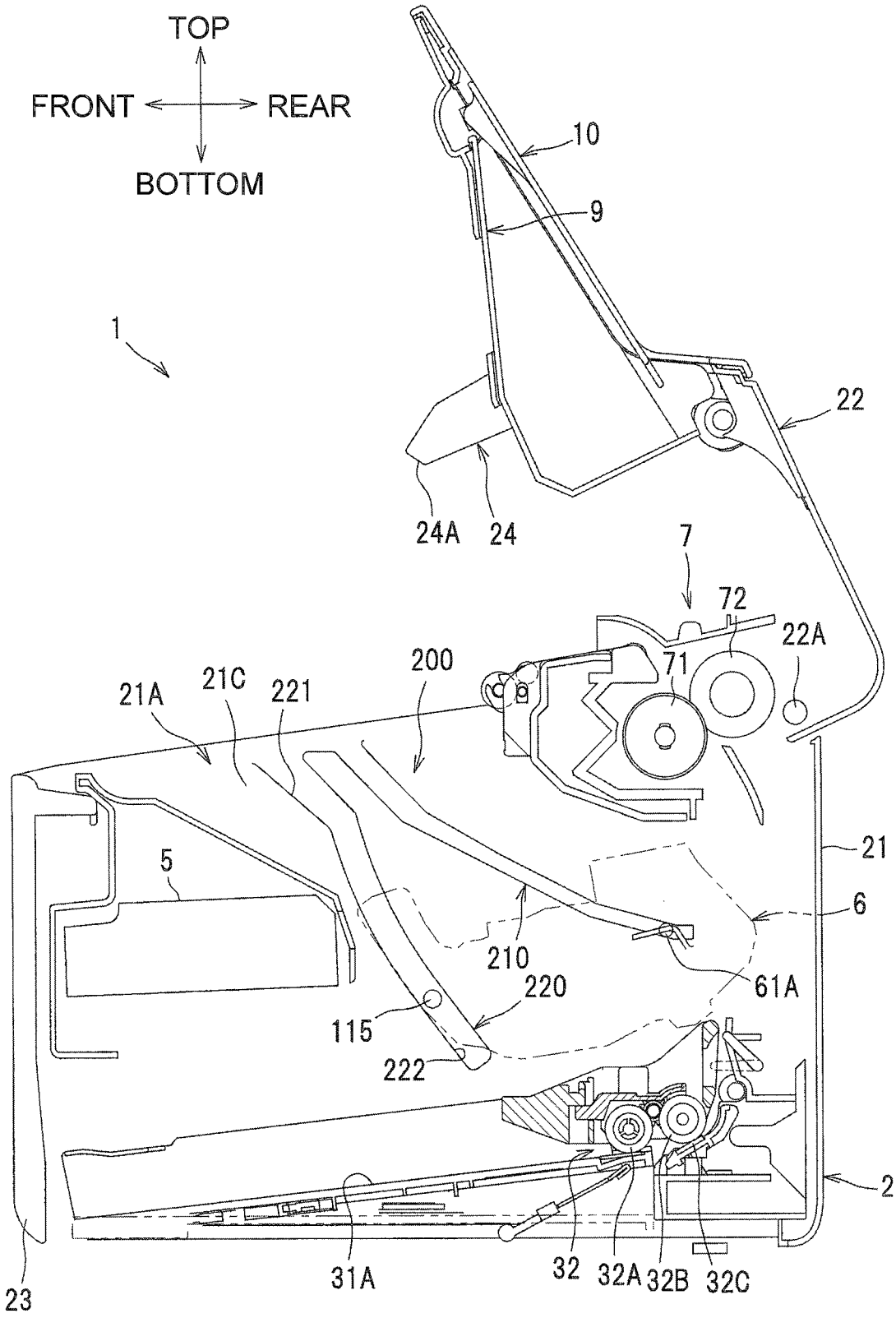
FIG. 8 illustrates that the process cartridge moves further toward an attachment position than that shown in FIG. 7.

As shown in FIG. 6, as the process cartridge 6 is guided by the first guide 210 to move into the casing 21, the boss 115 is inserted into the upper portion 221 of the second guide 220. As shown in FIG. 7, as the process cartridge 6 is pressed further inward, a portion of the second guide 220 that guides the boss 115 changes from the upper portion 221 to the lower portion 222. Thus, as shown in FIG. 8, the boss 115 is guide by the lower portion 222 to move toward the attachment position. At this time, the lower portion 222 allows the process cartridge 6 to move smoothly because the lower portion 222 has a smooth curved shape to the attachment position of the boss 115.

Figure 9:
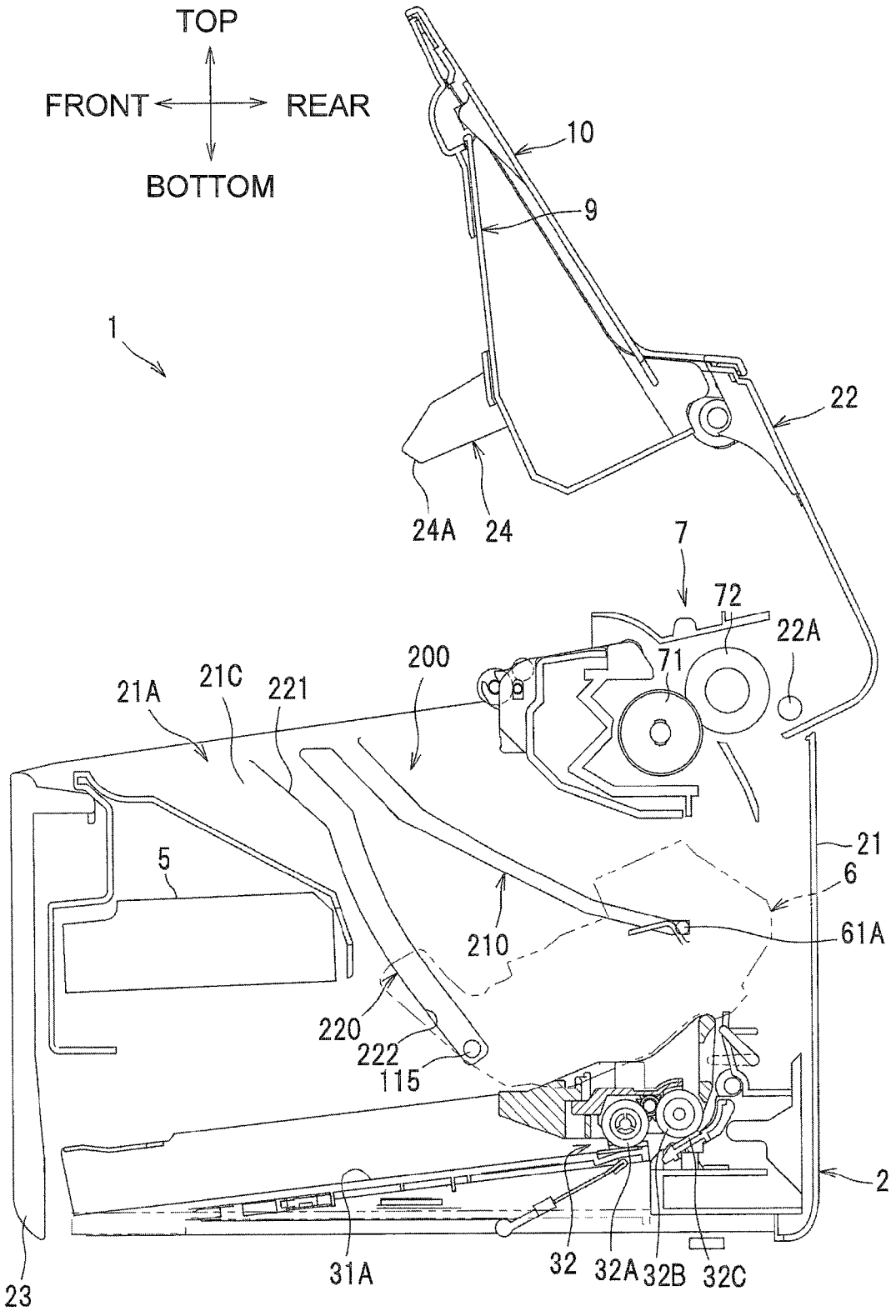
FIG. 9 illustrates that the process cartridge is attached to the casing.

After the shaft 61A of the photosensitive drum 61 stops at the end of the first guide 210, the boss 115 stops at the end of the lower portion 222 of the second guide 220 so that the process cartridge 6 is attached to the casing 21 as shown in FIG. 9.

As shown in FIG. 10, in a state that the user did not move the process cartridge 6 completely to the attachment position and thus the process cartridge 6 stops short of the attachment position, when the top cover 22 is closed, the pressing portion 24 contacts the pressed portion 114 of the process cartridge 6 located short of the attachment position, and presses the process cartridge 6 into the attachment position. Thus, even when the top cover 22 is closed with the process cartridge 6 not attached in position, the pressing portion 24 allows the process cartridge 6 to be attached in position.

In case of removing the process cartridge 6 from the casing 21, the user opens the top cover 22, holds the handle portion 113 of the process cartridge 6, and pulls the process cartridge 6 toward the user. At this time, the shaft 61A of the photosensitive drum 61 is guided by the first guide 210, the boss 115 is guided by the second guide 220, and the process cartridge 6 moves outward in the casing 21. At this time, as the lower portion 222 has a smooth curved shape from the attachment position of the boss 115 to the upper portion 221, a moving direction of the process cartridge 6 is not greatly changed in the vicinity of the attachment position of the boss 115. Thus, the process cartridge 6 can be pulled out smoothly.

According to the embodiment, the following effects can be obtained.

As the path of the pressing surface 24A in the casing 21 while the top cover 22 is opened or closed is substantially same as the shape of the second guide 220, the attaching direction of the process cartridge 6 agrees with the direction where the pressing surface 24A presses the process cartridge 6. Thus, the user can close the top cover while moving the process cartridge 6 to the attachment position lightly.

The direction where the pressing surface 24A presses the process cartridge 6 is substantially parallel to the direction where the second guide 220 extends in the vicinity of the boss 115. When the process cartridge 6 is pressed by the pressing surface 24A, the boss 115 is not pressed against the second guide 220. As there is little resistance from the second guide 220, the user can press the top cover 22 lightly to close the top cover 22.

When contacting the process cartridge 6, the pressing surface 24A is disposed in the position where it overlaps the second guide 220 in the radial direction of a circle centered on the pivot 22A of the top cover 22. Thus, compared with a case where the pressing surface 24A is disposed in a position away from the second guide 220, the process cartridge 6 can be prevented from being twisted when being pressed by the pressing surface 24A.

The pressed portions 114 are disposed at the upper end portion of the entire process cartridge 6, and the bosses 115 are disposed at the upper end portion of the side surfaces 111 of the process cartridge 6. Thus, the pressed portions 114 and the bosses 115 are disposed near each other. The moving direction of the bosses 115 is similar to the direction where the pressing surface 24A presses.

The above embodiment shows, but is not limited to, that the pressing surface 24A is disposed in the position where it overlaps the second guide 220 in the radial direction of a circle centered on the pivot 22A of the top cover 22. For example, the pressing surface 24A may be disposed in a position shifted from the second guide 220 in the radial direction of a circle centered on the pivot 22A when the pressing surface 24A contacts the pressed portions 114 of the process cartridge 6.

The above embodiment shows, but is not limited to the pressing surface 24A which is flat and formed at a distal end of the pressing portion 24. For example, the pressing portion 24 may have a round distal end which is to contact the pressed portions 114 of the process cartridge 6. In this case, a point of the distal end of the pressing portion 24 that contacts the pressed portion 114 is a pressing portion.

The above embodiment shows, but is not limited to, that the photosensitive drum 61 is illustrated as the photosensitive member. A belt-shaped photosensitive member may be used.

While the features herein have been described in connection with various example structures and illustrative aspects, it will be understood by those skilled in the art that other variations and modifications of the structures and aspects described above may be made without departing from the scope of the inventions described herein. Other structures and aspects will be apparent to those skilled in the art from a consideration of the specification or practice of the features disclosed herein. It is intended that the specification and the described examples only are illustrative with the true scope of the inventions being defined by the following claims.

What is claimed is:

1. An image forming apparatus comprising:

a casing having an opening that is open upward;

a cover supported by the casing such that the cover is configured to pivot around a pivot axis to open and close the opening, the cover including a pressing portion;

a process cartridge configured to be attached to or removed from the casing through the opening; and a particular guide configured to guide the process cartridge when the process cartridge is attached to or removed from the casing, wherein the pressing portion is configured to, when the cover is closing the opening, contact the process cartridge being attached inside the casing and press the process cartridge toward an attachment position in which the process cartridge is attached to the casing, wherein a path of the pressing portion in the casing, while the cover pivots, is substantially a same shape as a shape of the particular guide as viewed from an axial direction of the pivot axis, and wherein the path of the pressing portion and the shape of the particular guide are arc shaped having substantially a same radius from the pivot axis.

2. The image forming apparatus according to claim 1, wherein the process cartridge includes a particular guided portion to be guided by the particular guide, and wherein a direction where the pressing portion presses the process cartridge is substantially parallel to a direction where the particular guide extends in proximity to the particular guided portion.

3. The image forming apparatus according to claim 2, further comprising a further guide.

4. The image forming apparatus according to claim 3, wherein the process cartridge further includes a photosensitive member and a further guided portion disposed closer to the photosensitive member than the particular guided portion, and wherein the further guide is configured to guide the further guided portion of the process cartridge when the process cartridge is attached to or removed from the casing.

5. The image forming apparatus according to claim 4, wherein the particular guide and the further guide are shaped such that, during attaching of the process cartridge, the particular guided portion is guided to a downstream end of the particular guide after the further guided portion is guided to a downstream end of the further guide.

6. The image forming apparatus according to claim 5, wherein the further guide is shaped such that a downstream side of the further guide in an attaching direction of the process cartridge is gradually away from the path of the pressing portion.

7. The image forming apparatus according to claim 2, wherein the particular guided portion of the process cartridge to be pressed by the pressing portion is disposed in an upper end portion of a whole of the process cartridge, and the particular guided portion is disposed in an upper end portion of a side surface of the process cartridge.

8. The image forming apparatus according to claim 1, wherein the pressing portion is disposed in such a position that, when the pressing portion contacts the process cartridge, the pressing portion overlaps the particular guide as viewed from the axial direction of the pivot axis.

9. The image forming apparatus according to claim 8, further comprising a further guide, wherein the further guide is shaped such that a downstream side of the further guide in an attaching direction of the process cartridge is closer to the pivot axis of the cover than a downstream side of the particular guide is.

10. The image forming apparatus according to claim 1, wherein the pressing portion protrudes downward when the cover closes the opening of the casing.

11. The image forming apparatus according to claim 1, further comprising a fixing unit, the pivot axis being positioned such that the fixing unit is positioned between the pivot axis and the particular guide.

* * * * *